United States Patent [19]

Senk

[11] 4,170,064

[45] Oct. 9, 1979

[54] HAIR-DRESSING SCISSORS

[75] Inventor: Heinz Senk, Solingen, Fed. Rep. of Germany

[73] Assignee: Spengler & Meurer, Solingen, Fed. Rep. of Germany

[21] Appl. No.: 905,619

[22] Filed: May 12, 1978

[30] Foreign Application Priority Data

May 13, 1977 [DE] Fed. Rep. of Germany ..... 2721672

[51] Int. Cl.[2] ..... B26B 19/22

[52] U.S. Cl. ..... 30/195

[58] Field of Search ..... 30/195

[56] References Cited

U.S. PATENT DOCUMENTS 2,606,365 8/1952 Pileggi ..... 30/195

3,257,723 6/1966 Cercone ..... 30/195

3,571,928 3/1971 Willey ..... 30/195

FOREIGN PATENT DOCUMENTS 552139 12/1930 Fed. Rep. of Germany ..... 30/195

*Primary Examiner*—Jimmy C. Peters

*Attorney, Agent, or Firm*—John C. Smith, Jr.

[57] ABSTRACT

A hair-dressing scissors comprises a first scissor blade provided with a smooth cutting edge and a second scissor blade which has serrations. The first blade with the scissors closed extends with its smooth cutting edge beyond the base of the serrations of the second blade and the inward edges at the base of the teeth gaps are rounded.

2 Claims, 4 Drawing Figures

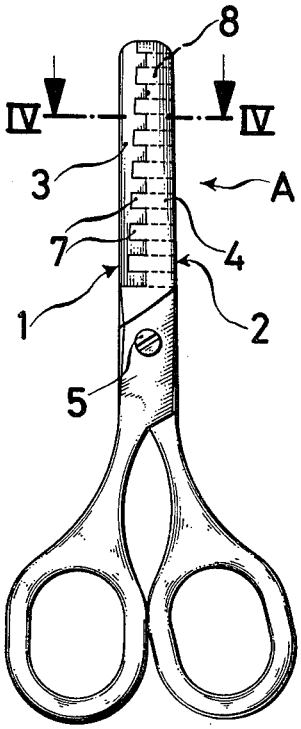
FIG. 1
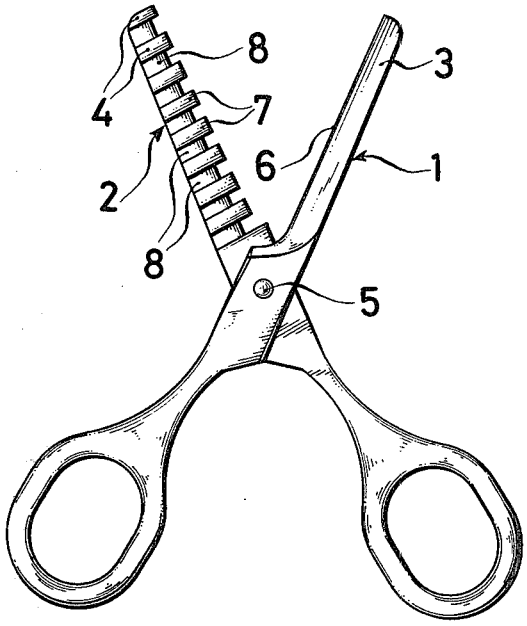
FIG. 2
FIG. 3
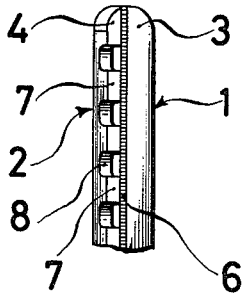
FIG. 4
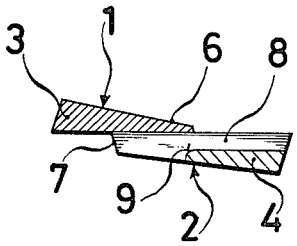

HAIR-DRESSING SCISSORS

BACKGROUND OF THE INVENTION

This invention relates to a hair-dressing scissors the one scissor blade of which is serrated.

Such scissors are known. With the conventional scissors, the one scissor blade when the scissors are closed overlaps the teeth and teeth gaps of the other scissor blade with its cutting edge throughout a portion of the length thereof so that between the cutting edge and the base of the teeth gaps there are free interstices. Such scissors serve to effilate the head hair in that upon gripping underneath a tuft of hair separated from the head hair with the scissor blade of the one scissors half upon closing the scissors the hairs in front of the teeth of the scissor blade of the other scissors half are cut, while the hairs in the teeth gaps are not cut. Thus, the entire tuft of hair engaged by the scissors is effilated, thus also the upper hair. A shortening of the upper hair has an adverse effect, however, because the shortened upper hairs which generally do not smoothly engage the head hairs like the unshortened upper hairs do laterally project in relationship to the unshortened upper hairs, i.e. stand out, the appearance of the hair-dress being impaired. The hair-dresser up to now has overcome this problem in that he after separating a tuft of hair from the head hair thins out the hairs underneath the upper hairs of the tuft of hair by short cuts with the tip of the scissors. The individual handled hair portions thus merge into one another steplessly, the length of the upper hairs thereby being maintained. This operation is relatively complicated, however, and time-consuming and has as a condition some skill.

SUMMARY OF THE INVENTION

It is, therefore, the object of the present invention to design hair-dressing scissors of the species set forth initially in such a way that with them after separating a tuft of hair from the head hair substantially only the hairs underneath the upper hairs are effilated.

To attain this object the present invention provides a hair-dressing scissors which comprises two crossed scissors halves; a fulcrum screw joining said halves to one another; a scissor blade provided with serrations having a base and forming tooth gaps having a base; a scissor blade having a smooth cutting edge, said blades interacting to shear hair, and a handle formed at each longitudinally inward portion of each blade, the scissor blade having the smooth cutting edge with the scissors closed extending with its smooth cutting edge beyond the base of the serrations of the other scissor blade and the inward edges at the base of the teeth gaps being rounded.

The teeth gaps of the serrated scissor blade conveniently are dimensioned in such a way in relationship to their widths that in contradistinction to effilating scissors having a fine-serrated scissor blade the hairs taken up by the scissors for greatly the major part are in the teeth gaps. When now a tuft of hair separated from the head hair is engaged from below by the smooth cutting edge of the one scissor blade of the scissors proposed by the invention, upon closing the scissors the hairs in the teeth gaps are turned via the rounded edges at the base of the teeth gaps against the internal side of the serrated scissor blade and in doing so only the rearward hairs of the tuft of hair are effilated, while the upper hairs for by far the major part remain uncut.

Advantageously, the serrated scissor blade inwardly in a continuation of the teeth gaps has groove-like depressions merging into the back of the serrated scissor blade.

When the scissors are closed and the hairs are turned, the latter for a major part move into the depressions of the serrated scissor blade. In this way it is prevented in an advantageous way that for a thicker tuft of hair the scissor blades lift off from one another increasingly toward the tip, i.e. expand, thereby the portion of the tuft of hair becoming effilated only which is in close proximity to the fulcrum of the scissors. Since, however, a large part of the tuft of hair moves into the depressions, an effilating of the rearward hairs of the tuft of hair is ensured throughout the length of the scissor blades.

BRIEF DESCRIPTION OF THE DRAWING

An embodiment of the invention will now be described by way of example and with reference to the accompanying drawing, in which:

FIG. 1 is a front elevational view of a closed hair-dressing scissors according to the invention;

FIG. 2 is a rear elevational view of the opened scissors;

FIG. 3 is a rear elevational view of a detail of the closed scissors, and

FIG. 4 is a sectional view, on an enlarged scale, taken on the line IV—IV of FIG. 1.

DESCRIPTION OF THE PREFERRED EMBODIMENT

The reference numerals 1 and 2 designate two crossed scissors halves. The reference numerals 3 and 4 designate scissor blades the longitudinally inward end portions of which are formed with handles. The scissors halves 1 and 2 are joined to one another by means of a fulcrum screw 5. The scissor blade 3 is provided with a smooth cutting edge 6, and the scissor blade 4 is provided with serrations 7.

The scissor blade 3 with the scissors closed extends with its cutting edge 6 beyond the base of the serrations 7 of the scissor blade 4 so that the serrations 7 are completely overlapped by the scissor blade 3. At the teeth gaps of the scissor blade 4, rearwardly there are provided groove-like depressions 8 which merge into the back of the scissor blade 4. The inward edges designated 9 at the base of the teeth gaps are rounded like illustrated in FIG. 4.

The invention may be embodied in other specific forms without departing from the spirit or essential characteristics thereof. The embodiment is therefore to be considered in all respects as illustrative and not restrictive.

What is claimed is:

1. A hair-dressing scissors comprising (a) two crossed scissors halves (1,2);

(b) a fulcrum screw (5) joining said halves to one another;

(c) a scissor blade (4) provided with serrations (7) having a base and forming tooth gaps having a base;

(d) a scissor blade (3) having a smooth cutting edge (6), said blades interacting to shear hair, and (e) a handle formed at each longitudinally inward portion of each blade, the scissor blade having the smooth cutting edge with the scissors closed extending with its smooth cutting edge beyond the base of the serrations (7) of the other scissor blade (4) and the inward edges (9) at the base of the teeth gaps being rounded.

2. A hair-dressing scissors according to claim 1, wherein the serrated scissor blade (4) inwardly in continuation of the teeth gaps has groove-like depressions (8) merging into the back of the serrated scissor blade.

* * * * *